United States Patent [19]

Reed

[11] 4,263,762

[45] Apr. 28, 1981

[54] STRUCTURAL FOUNDATION ASSEMBLY

[76] Inventor: Stanley B. Reed, 7402 E. Camelback, Ste. A, Scottsdale, Ariz. 85251

[21] Appl. No.: 19,225

[22] Filed: Mar. 9, 1979

[51] Int. Cl.[3] ..... E02D 27/00

[52] U.S. Cl. ..... 52/293; 52/169.1

[58] Field of Search ..... 52/169.1, 293, 274, 52/292, 169.7, 58, 169.8; 405/229, 284

[56] References Cited

U.S. PATENT DOCUMENTS

| | | | |
|---|---|---|---|
| 2,078,969 | 5/1937 | Patterson | 52/293 X |
| 2,651,391 | 9/1953 | Havens | 52/58 X |
| 2,915,150 | 12/1959 | Weidler | 52/293 X |
| 3,420,016 | 1/1969 | Findlay | 52/274 X |
| 3,657,849 | 4/1972 | Garton | 52/293 X |
| 3,820,295 | 6/1974 | Folley | 52/293 X |
| 4,055,922 | 11/1977 | Ellington et al. | 52/169.7 |

FOREIGN PATENT DOCUMENTS

| | | | |
|---|---|---|---|
| 657224 | 6/1965 | Belgium | 52/293 |

*Primary Examiner*—Price C. Faw, Jr.
*Assistant Examiner*—Carl D. Friedman
*Attorney, Agent, or Firm*—Harry M. Weiss

[57] ABSTRACT

This relates to an improved foundation assembly for supporting structures. A plurality of vertical studs are positioned in upper and lower tracks. This stud and track assembly is further coupled to a joist which rests at the bottom of a foundation channel cut in the earth. A form deck is coupled to the stud and track assembly, and the channel is back-filled to provide the necessary stabilization. Floor joists are coupled to the foundation assembly which extends above the natural soil line and the back-fill grade. This creates an internal crawl space which provides insulation between the floor and the earth below.

11 Claims, 3 Drawing Figures

STRUCTURAL FOUNDATION ASSEMBLY

BACKGROUND OF THE INVENTION

1. Field of the Invention

This invention relates generally to structural foundations and more particularly to a mechanically coupled footing/foundation assembly for supporting a structure.

2. Description of the Prior Art

As is well known, it is often necessary to provide a footing (e.g. of concrete) and a foundation (e.g. of concrete block) to properly support a building structure (e.g. a house, apartment building, office building, etc.). In addition to being costly and time consuming, there is always the risk that the recently poured concrete footing will be damaged by adverse weather conditions unless great care is taken to adequately shelter and protect the footing.

In addition to the construction problems mentioned above, the integrity of concrete/block foundation assemblies is diminished by cracks and other openings which are caused by either faulty construction or settling. Such openings permit intrusions by the elements (e.g. wind and water), insects, rodents and the like.

Concrete or other material may be poured within the area defined by the footing to form a first or basement floor surface. This surface is generally below ground level and in direct contact with the earth below. Thus it is often cold and damp.

SUMMARY OF THE INVENTION

It is an object of the present invention to provide an improved footing and foundation assembly for supporting structures.

It is a further object of the invention to provide an improved footing/foundation assembly, the components of which require only positioning and mechanical coupling.

It is a still further object of the invention to provide an improved footing/foundation assembly, the construction of which is substantially unaffected by adverse weather conditions.

It is yet another object of the invention to provide an improved footing/foundation assembly which is weather tight and less penetrable by insects, rodents and the like.

Finally it is an object of the present invention to provide an improved footing/foundation assembly which better insulates the supported structure from the earth below.

According to a broad aspect of the invention there is provided a foundation assembly for supporting floor joists, said foundation assembly being positioned within a channel in the earth which is subsequently back-filled, said assembly comprising a base member positioned at the bottom of said channel; a plurality of substantially vertical stud members coupled to said base member and extending upwardly therefrom; and an upper member coupled to each of said vertical members for supporting said floor joists.

The above and other objects, features and advantages will become more apparent from the following detailed description taken in conjunction with the accompanying drawings in which:

DESCRIPTION OF THE PREFERRED EMBODIMENT

Figure 1:
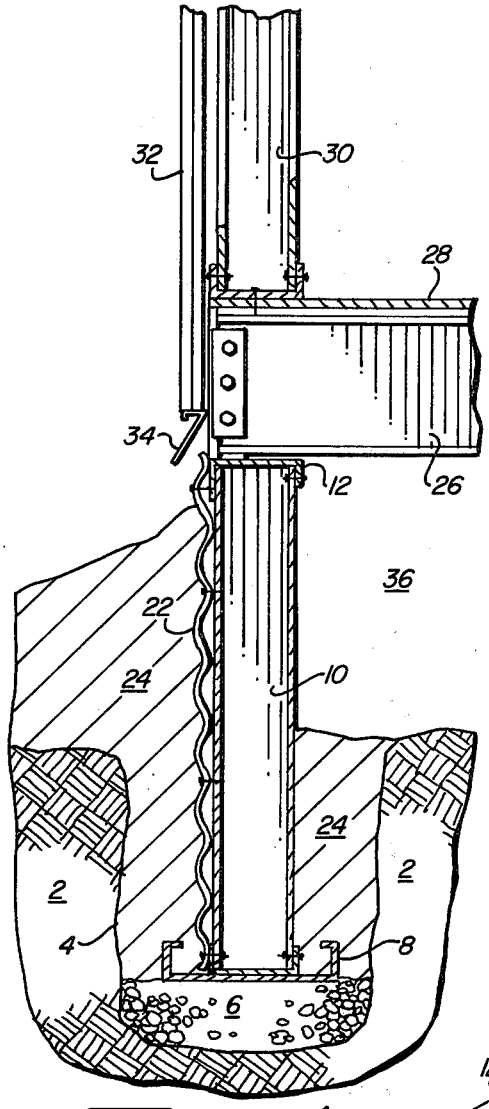
FIGS. 1 and 2 illustrate the components which comprise the inventive footing/foundation and the interrelationship therebetween.
Figure 2:
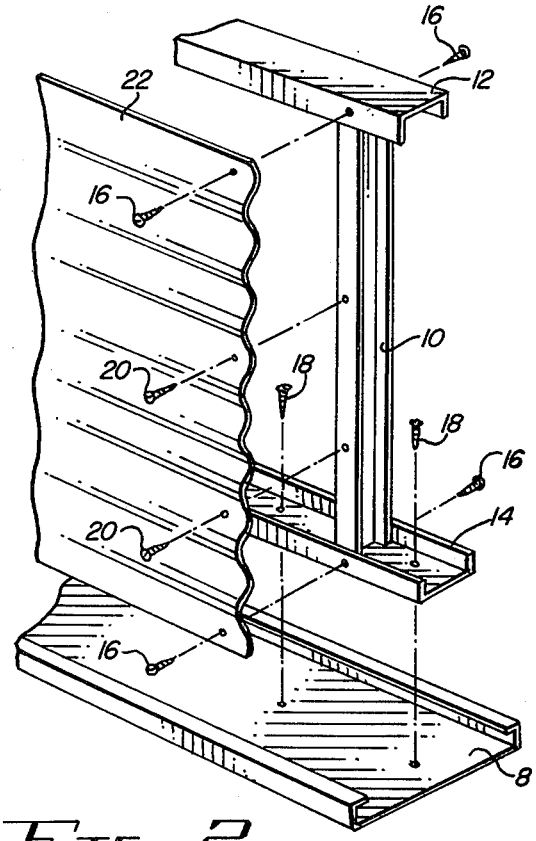

FIGS. 1 and 2 illustrate the components of the inventive footing/foundation assembly and the interrelationships therebetween. The natural soil 2 has a channel 4 cut therein which is then filled with a support base consisting of approximately six inches of crushed stone or pea gravel 6.

A U-shaped joist 8 (e.g. SC-10J-16) having a flat base forms the lower portion of the footing/foundation assembly and is supported by the crushed stone 6 as is shown in FIG. 1. A plurality of vertical studs (e.g. SC-4SS-18) 10, only one of which is shown for clarity, are positioned in upper and lower tracks (e.g. SC-4CT-18) 12 and 14 respectively, and are coupled thereto by self-drilling screws 16 (FIG. 2). The track and stud assembly is supported by joist 8 and is coupled thereto by self-drilling screws 18 (FIG. 2). The outer surface of the footing/foundation assembly comprises a form deck 22 (e.g. FD 3¾-24GA.) which is fixed to the track and stud assembly by self-drilling screws 16 and 20.

Referring to FIG. 1, the assembly shown in FIG. 2 is positioned within channel 4 and the channel is back-filled with material (e.g. earth) as is shown at 24. The back-fill covers joist 8 and fills the regions between adjacent studs 10 resulting in a strong and stable foundation upon which the remainder of the structure may be constructed.

FIG. 1 illustrates how floor joists 26 are coupled to the foundation assembly, which floor joists support flooring material 28 (e.g. plywood) studs 30, only one of which is shown, are mechanically coupled to the floor joists. These studs support both the internal walls of the structure and the exterior sheathing 32.

A flashing 34 enhances the integrity of the footing-/foundation assembly by deflecting the elements (e.g. rain, snow, etc.) from the region where the floor joists are coupled to the foundation assembly. Further, it should be clear from FIG. 1 that the structure is better insulated from the ground below due to the crawl space 36 between the earth and the floor joist 26. To resist corrosion, the components of the inventive footing-/foundation assembly are preferably made of galvanized and asphalt coated steel.

Figure 3:
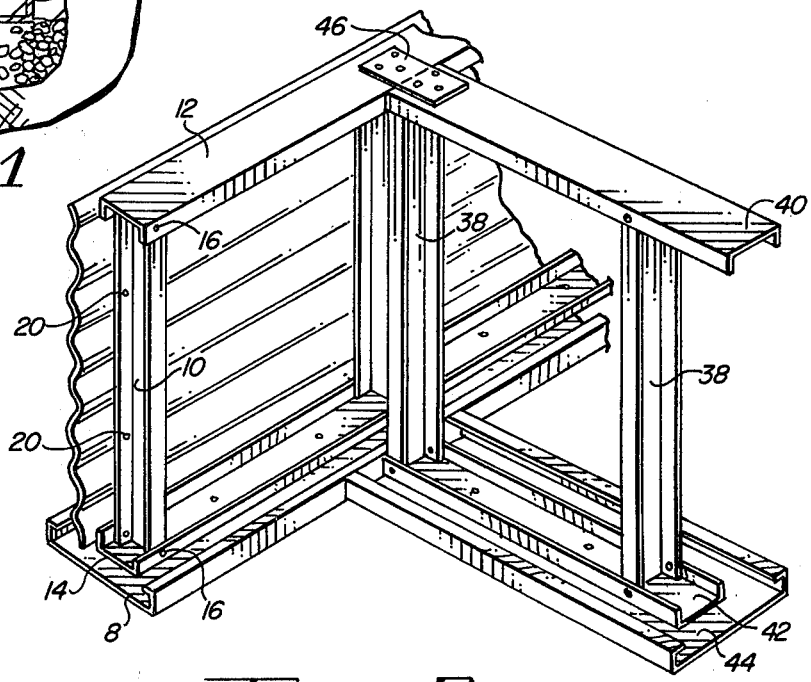
FIG. 3 illustrates an extension of the arrangement of FIGS. 1 and 2.

FIG. 3 illustrates an extension of the foundation assembly shown in FIGS. 1 and 2 which provides additional foundation support for an interior load bearing wall of the structure. An additional stud and track assembly (studs 38), tracks 40 and 42) is supported by a second joist 44. Interior foundation assemblies of this nature are coupled to the exterior foundation assembly (FIG. 1) by tie plates 46.

While the improved foundation assembly has been particularly shown and described with reference to a preferred embodiment thereof, it will be understood by those skilled in the art that changes in form and details may be made therein without departing from the spirit and scope of the invention.

What is claimed is:

1. A foundation assembly for supporting floor joists, said foundation assembly being positioned within a channel in the earth which is subsequently back-filled, said assembly comprising:

a base member having a performed U-shape portion positioned at the bottom of said channel;

a plurality of substantially vertical stud members coupled to said base member and extending upwardly therefrom; and an upper member coupled to each of said vertical members for supporting said floor joists.

2. An assembly according to claim 1 wherein said base member comprises:

a joist member comprising said preform U-shape portion; and a first track member having a base coupled to said joist member and having upward extending side members between which said stud members are coupled.

3. An assembly according to claim 2 wherein said stud members extend above the top of said lower channel so as to provide an insulating space between the floor joists and the earth below.

4. An assembly according to claim 2 wherein said upper member comprises a second track member having a base to which said floor joists are coupled and having downward extending side members between which said stud members are coupled.

5. An assembly according to claim 4 wherein said foundation assembly further comprising at least an interior foundation assembly having a coupling to an interior surface of said foundation assembly to permit medial portions of said joist members to be supported.

6. An assembly according to claim 4 further including a sheathing member coupled to said base member, upper member and said stud members for forming an exterior surface of said foundation assembly.

7. An assembly according to claim 6 further including a flashing having a coupling at an uppermost portion of said flashing to said floor joist for sheltering the junction of said sheathing, said upper member and said floor joist.

8. An assembly according to claim 6 wherein said foundation assembly further comprising a plurality of self-drilling screws, said self-drilling screws individually having communication with at least two different ones of said stud members, said base member, said upper member, said joist member, said first track member and said sheathing member.

9. An assembly according to claim 6 wherein said base member, said stud members and said upper members each having a steel composition.

10. An assembly according to claim 9 wherein said steel is galvanized.

11. An assembly according to claim 6 wherein said base member, said stud members and said upper member each having an asphalt coated, galvanized steel surface.

* * * * *

UNITED STATES PATENT AND TRADEMARK OFFICE

CERTIFICATE OF CORRECTION

PATENT NO. : 4,263,762

DATED : April 28, 1981

INVENTOR(S) : Stanley B. Reed

It is certified that error appears in the above-identified patent and that said Letters Patent is hereby corrected as shown below:

Claim 2, line 14, please change the word " preform" to -- preformed--

Claim 2, line 14, please change the word "shape" to --shaped--

Claim 3, is incorrect and should read, --An assembly according to Claim 2 wherein said upper member comprises a second track member having a base to which said floor joists are coupled and having downward extending side members between which said stud members are coupled.--

Claim 4 is incorrect and should read, --An assembly according to Claim 3 further including a sheating member coupled to said base member, upper member and said stud members for forming an exterior surface of said foundation assembly.--

Claim 5 is incorrect and should read, --An assembly according to Claim 4 wherein said base member, said stud members and said upper members each having a steel composition.--

UNITED STATES PATENT AND TRADEMARK OFFICE

CERTIFICATE OF CORRECTION

PATENT NO. : 4,263,762

DATED : April 28, 1981

INVENTOR(S) : Stanley B. Reed

It is certified that error appears in the above-identified patent and that said Letters Patent are hereby corrected as shown below:

Claim 6 is incorrect and should read, --An assembly according to Claim 5 wherein said steel is galvanized.--

Claim 7 is incorrect and should read, --An assembly according to Claim 4 wherein said base member, said stud members and said upper member each having an asphalt coated, galvanized steel surface.--

Claim 8 is incorrect and should read, --An assembly according to Claim 2 wherein said stud members extend above the top of said lower channel so as to provide an insulating space between the floor joists and the earth below.--

Claim 9 is incorrect and should read, --An assembly according to Claim 4 further including a flashing having a coupling at an uppermost portion of said flashing to said floor joist for sheltering the junction of said sheathing, said upper member and said floor joist.

Claim 10 is incorrect and should read, --An assembly

UNITED STATES PATENT AND TRADEMARK OFFICE

CERTIFICATE OF CORRECTION

PATENT NO. : 4,263,762

DATED : April 28, 1981

INVENTOR(S) : Stanley B. Reed

It is certified that error appears in the above-identified patent and that said Letters Patent are hereby corrected as shown below:

according to Claim 3 wherein said foundation assembly further comprising at least an interior foundation assembly having a coupling to an interior surface of said foundation assembly to permit medial portions of said joist members to be supported.--

Claim 11 is incorrect and should read, --An assembly according to Claim 4 wherein said foundation assembly further comprising a plurality of self-drilling screws, said self-drilling screws individually having communication with at least two different ones of said stud members, said base member, said upper member, said joist member, said first track member and said sheathing member.--

Signed and Sealed this

Fourteenth Day of December 1982

[SEAL]

Attest:

GERALD J. MOSSINGHOFF

Attesting Officer

Commissioner of Patents and Trademarks